US005284312A

United States Patent [19]

Dony

[11] Patent Number: 5,284,312

[45] Date of Patent: Feb. 8, 1994

[54] PILLAR INTENDED TO FORM PART OF A FURNITURE SUPPORT EQUIPPED WITH A GAS SPRING

[75] Inventor: Dominique Dony, Roulans, France

[73] Assignee: Airax, S.A., Montferrand Le Chateau, France

[21] Appl. No.: 903,454

[22] Filed: Jun. 24, 1992

[30] Foreign Application Priority Data

Jul. 1, 1991 [FR] France ..... 91 08156

[51] Int. Cl.[5] ..... F16M 11/00

[52] U.S. Cl. ..... 248/161; 248/622; 248/631; 297/344.19

[58] Field of Search ..... 248/161, 599, 600, 622, 248/407, 408, 409, 413, 404, 631; 297/345, 347

[56] References Cited

U.S. PATENT DOCUMENTS

| | | | |
|---|---|---|---|
| 4,139,175 | 2/1979 | Bauer | 248/404 |
| 4,183,689 | 1/1980 | Wirges | 297/347 X |
| 4,485,996 | 12/1984 | Beukema | 248/407 |
| 4,692,057 | 9/1987 | Lauderbach | 248/404 X |
| 4,720,068 | 1/1988 | Tornero | 248/161 |
| 4,756,496 | 7/1988 | Hosan | 297/345 X |
| 4,899,969 | 2/1990 | Bauer | 248/161 |
| 4,940,202 | 7/1990 | Hosan | 297/347 X |
| 4,969,619 | 11/1990 | Bauer | 248/161 |
| 4,979,718 | 12/1990 | Bauer | 297/347 X |
| 5,012,996 | 12/1991 | Poertzgen et al. . | |
| 5,149,035 | 9/1992 | Bonnema | 297/347 X |

FOREIGN PATENT DOCUMENTS

| | | |
|---|---|---|
| 84179627 | 9/1984 | Fed. Rep. of Germany . |
| 619604A5 | 10/1980 | Switzerland . |

*Primary Examiner*—J. Franklin Foss

*Attorney, Agent, or Firm*—Fitzpatrick, Cella, Harper & Scinto

[57] ABSTRACT

A pillar intended to form part of a furniture support, particularly of a seat, and composed of a sliding tube whose frustoconical top end is intended to be engaged with a force fit, by its top part, in a matching frustoconical cavity in the top part of the piece of furniture, and which slides in a support tube fastened to a foot of the piece of furniture. The sliding tube holds captive, with radial clearance, the body of a gas spring whose piston rod is fixed to the bottom of the support tube. A metal reinforcement sleeve is engaged with a force fit inside the frustoconical end part. Its bottom edge serves as a support surface for the top edge of the gas spring body. It is advantageously composed of a split bush carrying a tongue which secures against rotation a pushrod interposed between the locking control finger and an actuating lever.

11 Claims, 1 Drawing Sheet

PILLAR INTENDED TO FORM PART OF A FURNITURE SUPPORT EQUIPPED WITH A GAS SPRING

BACKGROUND OF THE INVENTION

The present invention relates to a pillar intended to form part of a furniture support or another piece of furniture equipped with a gas spring.

For a long time seats have been known which are equipped with gas springs and which are composed of the following parts:

a foot resting on the floor, a top part constituting the seating surface in the case of a seat interposed between the foot and the top part, and a substantially vertical central barrel called a "pillar", which is telescopic and adjustable in height.

In the present text references to position, such as "vertical", "top" and other expressions, relate to the situation occurring when the seat or other piece of furniture is in the position of use.

The seat pillar is in turn composed of three parts:

a bottom tube or "support tube" fastened to the foot, a top sliding tube fastened to the top part of the piece of furniture, and a lockable gas spring mounted inside the sliding tube and acting between the two tubes.

The gas spring balances the weight of the top part and serves to adjust the length of the pillar, and therefore to maintain the height selected for the top part. Its body is placed, with lateral clearance, in the sliding tube and its rod is fixed by its end remote from the piston on the bottom of the support tube. At its end remote from the rod the body carries an axially movable locking control finger.

The seating surface of the seat is equipped with a pivotable device enabling the control finger to be operated.

The pillar, inside which the gas spring has been placed, is often in the form of a unit delivered ready for use to the furniture manufacturer, who has simply to fasten it to the support and to the seating surface.

For this purpose the foot and the seating surface are each provided with a part in the form of a hollow cone, and the ends of the pillar, that is to say the ends of the support tube and of the sliding tube, have a corresponding matching conical shape for force fitting.

The gas spring body placed inside the sliding tube is held axially:

at the top by a stop means bearing against the inside surface of the cone and provided with a vertical through passage in which an axial pushrod intended for operating the control finger can move;

at the bottom by a detachable stop means provided with a vertical through passage in which the piston rod of the gas spring is movable.

An arrangement of this kind is described, for example, in German Utility Model No. 84.17962. According to the latter the top stop means is a frustoconical component of a material less rigid than that of the sliding tube.

Pillars of this kind generally give satisfaction and have a long life. Nevertheless, improvements are still possible.

The present invention seeks to provide a pillar for seats, which has a lengthened life without any substantial increase in the weight and the cost price of this pillar.

A systematic study of the causes of failures of existing pillars has shown that such failures occur most often at or near the conical end part of the sliding tube.

Without any wish to analyze here all the possible causes of this preferential location of failures, which may be numerous, it appeared to the inventor to be necessary to reinforce the pillar in that region.

An increase of the thickness of the metal of the sliding tube might have been contemplated. This would entail increased consumption of material and make it more difficult to form the conical part. In addition, as the outside diameter is dictated by the shape of the seating surface, it would have been necessary to reduce the inside diameter, and consequently also to reduce the diameter of the gas spring, which might then have become inadequate.

SUMMARY OF THE INVENTION

According to the present invention, the previously mentioned top stop means consists of a rigid metal sleeve fixed by a close force fit in the top part of the sliding tube and extending at least over the entire frustoconical end part of the tube.

Thus, for the reinforcement of the sliding tube use is made of a sleeve, which also serves as stop means for the gas spring. It is therefore not necessary to provide an additional component, it being sufficient to change the shape and the material of the stop means.

If the thickness of the sleeve is insufficient to enable it to serve as a stop means, provision may be made for it to be folded over inwards at the bottom, so as to form one or more practically radial surfaces, against which the top face of the gas spring body will bear.

The sleeve may be made from a portion of the cylindrical tube, to which an appropriate frustoconical shape is given in the press. In a preferred embodiment the sleeve is formed from a split bush. Shaping is then easier, and uniform contact between the sleeve and the inside surface of the cone is ensured.

For each embodiment, and in particular for the second mentioned, the invention makes it possible to provide an advantageous solution to a problem to which the prior art provides only expensive and complicated solutions, namely the problem of regulating the length of the operating range of the finger controlling the gas spring.

It is expedient to provide for the pushrod to be adjustable in length during or before the assembly of the piece of furniture. Relatively slight variations of the diameter of the frustoconical end parts of the sliding tube and of the corresponding hollow portion of the top part will in fact entail considerable variations of the axial position of the top end of the pushrod.

According to Swiss Patent No. 619,604, provision is made for the pushrod to have a bottom part into which is axially screwed a top part, which can be turned by hand or with a tool, while a pin passing through a vertical slit secures the bottom part against rotation, without preventing axial displacements.

In other constructions the pushrod has a non-circular cross-section and slides in a correspondingly shaped hole in the top stop means. The latter is prevented from turning in the sliding tube by being gripped between the top end of the gas spring body and the conical inside surface of the sliding tube. This makes it necessary to produce components of complicated shapes, quite apart from other disadvantages which will be explained later on.

The invention permits a simpler construction; in a preferred embodiment the sleeve is provided internally with raised portions cooperating with corresponding raised portions of the pushrod in order to prevent the rotation of the latter about the vertical axis. This avoids the weakening of the end region of the sliding tube by the provision of a slit.

If the sleeve is made from a length of tubing, the inside raised portions are prepared before, during or after it is given its conical shape. If the sleeve is made from a split bush, the inside raised portions are formed even more easily by folding, which may or may not be preceded by the formation of slits bounding the folded parts.

The use of a sleeve formed from a split bush enables one or more internal projections to be easily formed in any position on said bush, particularly on the lips of the slit, in order to form the raised portions preventing the rotation of the pushrod.

It is advantageous for the pushrod to be provided with resilient tongues of a shape and dimensions designed to enable it to be passed at will through the opening of the narrow part of the sleeve, while making it practically impossible for it to be unintentionally detached, for example as the result of a shock. The manufacturer of the pillar will thus be able to fit the pushrod in position, or to replace it with another at the request of the customer, before its despatch to the assembly site, without any risk of detachment of the pushrod during transport. The conical shape of the interior of the sleeve ensures that, during use, the tongues will slide with light friction and will not necessitate excessive force for the operation of the control finger.

As previously stated, the gas spring body is held in place by two stop means, at the top and bottom, and in certain forms of construction it is gripped against the top stop means in order to prevent the latter from turning about its own axis on the adjustment of the length of the pushrod. This gripping is achieved with the aid of the bottom stop means, which is often in the form of a screw. A construction of this kind subjects the gas spring body to a permanent axial stress and has the consequence that the stresses applied to the sliding tube by the top part of the piece of furniture, particularly the seating surface of the seat, are transmitted to it. This may be detrimental to the life of the unit, and is undesirable. In order to limit this disadvantage, it is possible to provide, as in DE-U-87.17962, for the top stop means to be of a material which is less rigid than the steel of which the sliding tube and the gas spring body are made, for example of "Zamak" alloy, but the resulting improvement is necessarily limited because a not inconsiderable axial stress is always necessary and an insufficiently rigid material would impair the accuracy of the adjustment of the length of the pushrod.

The invention has the consequence that axial gripping of the gas spring is not necessary, because the sleeve, which acts as the top stop means, cannot turn since it is held by a force fit.

As a result it is not necessary to apply a heavy axial stress to the gas spring body, and it is sufficient for the latter to be held in place in the sliding tube in such a manner as, in particular, to achieve silent operation.

In order to ensure that it will be held in this manner, the invention provides for a deformable member to be interposed between the bottom stop means and the gas spring body.

In one advantageous embodiment the bottom stop means is composed of a threaded member cooperating with a screwthread on the sliding tube, a stop provided at the bottom end of said tube limiting its displacement, and the deformable member is composed of a flexible collar integral with the stop means and projecting into the sliding tube so as to bear against the gas spring body.

BRIEF DESCRIPTION OF THE DRAWINGS

The invention will now be explained in greater detail with the aid of one practical example, which is illustrated in the drawings, in which.

DETAILED DESCRIPTION OF ONE EMBODIMENT OF THE INVENTION

Figure 1:
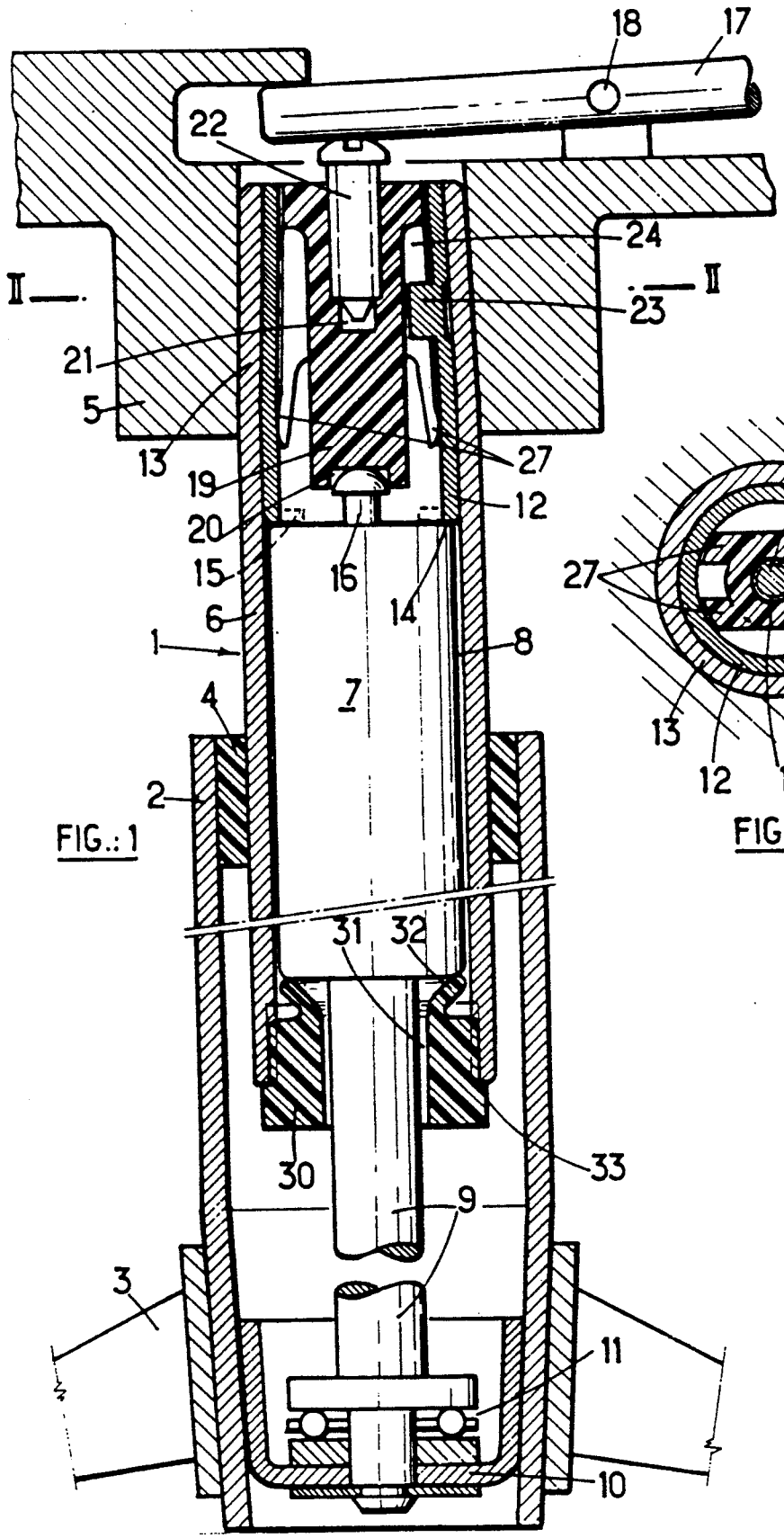
FIG. 1 is a partial longitudinal section of a seat support equipped with a pillar according to the invention.

The reference 1 designates generally the pillar, which will be described in detail further on. This pillar, which has a generally cylindrical shape with a convergent frustoconical top end, slides with light friction in a support tube 2 fastened to a foot 3, only part of which is shown in the drawing. The connection between the foot 3 and the support tube 2 is obtained through the fact that the bottom end of said tube is conical and is driven with a force fit into a conical aperture of corresponding shape in the foot. The invention is also applicable in the case of another type of connection, for example by welding. The support tube 2 is provided internally, towards its top end, with a bush 4 of plastic material having a low coefficient of friction, in order to facilitate the sliding of the pillar. The top part of the frustoconical end of the pillar 1 is driven with a force fit into a frustoconical cavity in a support member 5 fastened to the seating surface (not shown) of the seat.

The pillar 1 comprises a cylindro-frustoconical sliding tube 6 of metal, inside which is received the body 7 of a gas spring. A clearance 8, which according to present standards amounts to about 1.5% of the diameter of the body 7, exists between the tube 6 and the body 7. The piston rod 9 of the gas spring is directed downwards. It is fastened to the bottom 10 of the support tube 2 with the interposition of a ball bearing 11, in known manner.

In the arrangement illustrated the bottom 10 is composed of a bowl having a conical rim, of a shape suitable for being driven with a force fit into the conical bottom end of the support tube 2. It is clear that other shapes and methods of fastening, particularly by welding, are possible.

A steel reinforcement sleeve 12 is mounted with hard friction inside the tube 6 and extends as far as the top end of the latter, while the bottom end of the sleeve 12 extends downwards slightly beyond the frustoconical part 13 of the tube 6.

The thickness of the tube 12 is several times the dimension of the clearance 8 between the gas spring body 7 and the tube 6, so that said body comes to bear against the entire length of the bottom edge 14 of the sleeve 12 and cannot assume an oblique position. If it should be desired to be able to equip the pillar with a gas spring of a smaller diameter, it is possible to provide tongues 15, shown in dashed lines in the drawing, which are folded over inwards and are intended to serve as support surfaces for the gas spring.

A vertically movable control finger 16 projects from the top end of the gas spring body 7. It serves in known manner to secure the piston rod 9 in a desired position, in order to fix the height of the seat above the floor. When the finger 16 is pushed in, the locking action is released and said height can consequently be changed.

The control finger 16 is operated by the user with the aid of a lever 17 mounted by a joint 18 on the support member. The lever 17, only part of which is shown, actuates the finger 16 with the aid of a pushrod 19. This pushrod 19 is a component of plastic material which has a certain flexibility. Its bottom end 20 has a concave shape and bears against the convex end of the finger 16.

At the top the pushrod 19 has an axial blind hole 21, into which is driven a self-tapping screw 22, whose head can come into contact with the lever 17. It will be understood that by driving in the screw 22 into the pushrod 19 to a greater or lesser depth, the length of the unit, which length is close to that of the sleeve 12, can be varied such that in the position of rest the lever 17 does not exert a constant pressure on the control finger 16, but that the latter can nevertheless be easily actuated by the user in order to release the gas spring. A stop fastened to the support member limits the movement of the lever 17 in the direction away from the gas spring, and therefore fixes the maximum length that can be given to the unit comprising the pushrod 19 and the screw 22.

Figure 2:
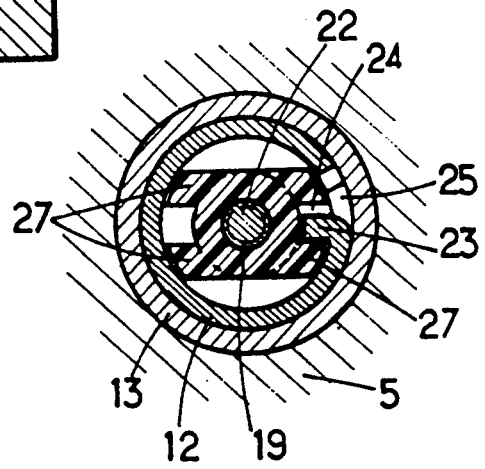
FIG. 2 is a horizontal section of the pillar, taken on the line II—II in FIG. 1.

As can be seen more clearly in FIG. 2, a tongue 23 integral with the bush is folded over inwards and penetrates into a longitudinal groove 24 in the pushrod 19. The cooperation of the folded-over tongue 23 and the groove 24 prevents the rotation of the pushrod 19 about the vertical axis, while allowing it to slide parallel to said axis. When the screw 22 is turned in one direction or the other in order to adjust the length of the unit comprising the pushrod and the screw, the pushrod itself is thus secured against rotation in a simple manner, and without an additional component, by the bush 12.

In a variant the folded-over tongue 23 extends over the entire length of one of the lips of the slit 25 in the bush.

FIG. 2 shows that the pushrod 19 also carries deformable tongues 27, which come to bear against the inside surface of the sleeve 12. These tongues hold the pushrod inside the sleeve during the transport which precedes assembly and during actual assembly, while allowing the pushrod 19 to be moved with light friction inside the sleeve 12. This is due to the fact that the internal conicity of the sleeve 12 has the effect of increasing friction if the pushrod 19 is pushed or pulled in the direction moving it out of the tube 6.

The bottom end of the tube 6 has an internal screwthread and is provided with a threaded stopper 30, which has an axial hole 31 for the passage of the piston rod 9 of the gas spring and which at the top, that is to say the end inside the tube 6, is provided with a deformable collar 32 against which the bottom end of the gas spring body 7 continuously bears flexibly, so that the latter is supported and any shocks or stresses to which said body may be subjected will be damped.

The stopper 30 is provided with a shoulder 33, which comes to bear against the bottom edge of the tube 6, so as to prevent excessively tight gripping of the stopper, which would reduce the effect of the flexible collar 32.

We claim:

1. A pillar intended to form part of a piece of furniture when interposed between a foot and a top part of said piece of furniture, said pillar comprising:

a support tube which can be fastened to the foot;

a sliding tube having a top conical end portion which can be engaged by a force fit in a correspondingly shaped cavity in the top part; and a gas spring, said gas spring including a body, a piston rod, and a control finger, said body disposed in the sliding tube, with lateral clearance therebetween, said rod being fixed, at its end remote from the piston, to the bottom of the support tube, said control finger being located at an end of said body remote from said rod, wherein said pillar is further equipped with a top stop means, situated in the top end portion of the sliding tube, to limit upward movement of the gas spring body, said top stop means including a vertical through passage in which a pushrod is movable to actuate said control finger and a rigid sleeve which is force fitted within the entire conical end portion of the sliding tube, in order to reinforce said tube, and wherein said sliding tube includes a bottom stop means situated at the bottom of the sliding tube and adapted to limit downward displacement of the gas spring body, said bottom stop means having a vertical through passage in which the piston rod of the gas spring can move.

2. The pillar of claim 1, wherein the sleeve is folded over inwards at the bottom to form one or more practically radial surfaces against which the top face of the gas spring body will bear.

3. The pillar of claim 1, wherein the sleeve is made from a portion of cylindrical tubing having a frustoconical shape.

4. The pillar of claim 1, wherein the sleeve is formed from a split bush.

5. The pillar of claim 1, wherein the pushrod has an axial hole at a top portion thereof, and further comprising a length adjustment screw mounted in said axial hole, and wherein means is provided to secure the pushrod against rotation during adjustment, without preventing its axial movement.

6. The pillar of claim 1, wherein said internal raised portion of the sleeve is formed by at least one part of at least one lip of the slit which is folded over toward the center of the sleeve.

7. The pillar of claim 1, wherein the pushrod includes elastic tongues which slide with light friction over at least the narrowest part of the internal surface of the sleeve.

8. The pillar of claim 1, wherein a deformable member adjoins the bottom stop means and comes to bear against the gas spring body.

9. The pillar of claim 8, wherein the bottom stop means includes a threaded component which cooperates with a screwthread on the sliding tube and a stop provided at the bottom end of said tube for limiting its movement, and wherein the deformable member includes a flexible collar which projects into the interior of the sliding tube.

10. The pillar of claim 5, wherein said means for securing the pushrod includes at least one raised portion formed on an internal surface of said sleeve which cooperates with at least one recessed portion formed on an outer surface of the pushrod.

11. The pillar of claim 1, further comprising a locking control level for moving said pushrod to actuate said control finger.

* * * * *